US007130572B2

(12) United States Patent
Kubochi et al.

(10) Patent No.: US 7,130,572 B2
(45) Date of Patent: Oct. 31, 2006

(54) IMAGE HEATING APPARATUS USING A FLEXIBLE SLEEVE

(75) Inventors: Yutaka Kubochi, Mishima (JP); Fumiki Inui, Mishima (JP); Kazunari Nishimoto, Mumazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/091,370

(22) Filed: Mar. 29, 2005

(65) Prior Publication Data

US 2005/0220509 A1 Oct. 6, 2005

(30) Foreign Application Priority Data

Mar. 31, 2004 (JP) ..... 2004-105248

(51) Int. Cl.
*G03G 15/20* (2006.01)

(52) U.S. Cl. ..... 399/329; 399/328

(58) Field of Classification Search ..... 399/328, 399/329, 320

See application file for complete search history.

(56) References Cited

U.S. PATENT DOCUMENTS

| | | | | |
|---|---|---|---|---|
| 4,970,219 | A | 11/1990 | Effland et al. | 514/339 |
| 4,983,615 | A | 1/1991 | Effland et al. | 514/337 |
| 5,034,403 | A | 7/1991 | Effland et al. | 514/338 |
| 5,083,168 | A | 1/1992 | Kusaka et al. | 355/285 |
| 5,149,941 | A | 9/1992 | Hirabayashi et al. | 219/216 |
| 5,162,634 | A | 11/1992 | Kusaka et al. | 219/216 |
| 5,210,579 | A | 5/1993 | Setoriyama et al. | 355/285 |
| 5,221,682 | A | 6/1993 | Effland et al. | 514/349 |
| 5,262,834 | A | 11/1993 | Kusaka et al. | 355/285 |
| 5,300,997 | A | 4/1994 | Hirabayashi et al. | 355/285 |
| 5,343,280 | A | 8/1994 | Hirabayashi et al. | 355/285 |
| 5,405,856 | A | 4/1995 | Effland et al. | 514/349 |
| 5,525,775 | A | 6/1996 | Setoriyama et al. | 219/216 |
| 5,767,484 | A | 6/1998 | Hirbayashi et al. | 219/216 |
| 6,049,691 | A * | 4/2000 | Abe et al. | 399/328 |
| 6,961,532 | B1 * | 11/2005 | Uekawa et al. | 399/329 |
| 2005/0180788 | A1 * | 8/2005 | Watanabe et al. | 399/328 |

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-204980 | 7/1992 |
| JP | 9-68878 | 3/1997 |
| JP | 2002-246151 | 8/2002 |

* cited by examiner

*Primary Examiner*—David M. Gray
*Assistant Examiner*—Ruth N LaBombard
(74) *Attorney, Agent, or Firm*—Fitzpatrick, Cella, Harper & Scinto

(57) ABSTRACT

The image heating apparatus for heating an image formed on a recording material includes a flexible sleeve and a regulating member disposed at a position opposed to an end surface of the sleeve for regulating the movement of the sleeve in a generatrix direction thereof, the regulating member having a first surface opposed to the end surface of the sleeve, and a second surface opposed to the inner peripheral surface of the end portion of the sleeve in the generatrix direction thereof, wherein the regulating member is a combination of a first part having the first surface and a second part having the second surface. Thereby, the damage of the end portion of the flexible sleeve can be suppressed.

11 Claims, 7 Drawing Sheets

IMAGE HEATING APPARATUS USING A FLEXIBLE SLEEVE

BACKGROUND OF THE INVENTION

1. Field of the Invention

This invention relates to an image heating apparatus suitable for use as a fixing apparatus carried on a copying machine or a printer using a recording technique such as an electrophotographic recording process or an electrostatic recording process.

2. Description of the Related Art

In image forming apparatuses such as electrophotographic copying machines and printers, a heat fixing apparatus of a heat roller type has heretofore been widely used as a fixing apparatus for heating and fixing an unfixed toner image indirectly (transfer) or directly formed and borne on a recording material (paper) as a material to be heated by suitable image forming process means such as electrophotographic process means as a permanent fixed image on the surface of the recording material.

In recent years, from the viewpoints of quick start and energy saving, a heat fixing apparatus of a film heating type has been put into practical use. The fixing apparatus of the film heating type is proposed, for example, in Japanese Patent Application Laid-open No. S63-313182, Japanese Patent Application Laid-open No. H2-157878, Japanese Patent Application Laid-open No. H4-44075 and Japanese Patent Application Laid-open No. H4-204980.

That is, a flexible sleeve (hereinafter referred to as the fixing film) is nipped between e.g. a ceramic heater as a heating member and a pressure roller as a pressure member to thereby form a pressure contact nip (hereinafter referred to as the fixing nip portion), and a recording material having an unfixed toner image formed and borne thereon is introduced into between the fixing film and the pressure roller in the fixing nip portion and is nipped and conveyed together with the fixing film, whereby the unfixed toner image is fixed on the surface of the recording material by the pressure force of the fixing nip portion while the heat of the ceramic heater is given thereto through the fixing film.

This fixing apparatus of the film heating type can constitute an apparatus of an on-demand type by the use of members of low heat capacity as the ceramic heater and the film, and only during the execution of image forming, the ceramic heater as a heat source can be electrically energized to thereby generate heat to a predetermined fixing temperature, and there are the advantages that the waiting time from the turn-on of the power supply switch of the image forming apparatus until a state in which image forming can be executed is short, and that the power consumption during standby can be greatly curtailed.

When the film is used in the film heating process, shifting in the generatrix direction of the film may sometimes occur, and it is difficult to severely control this. So, in Japanese Patent Application Laid-open No. H4-44075, Japanese Patent Application Laid-open No. H4-204980, etc., it is proposed to wind film loosely to thereby reduce the shifting force of the film and receive the end portion of the film by the film end portion regulating surface (hereinafter referred to also as the "regulating surface") of a flange, and effect the regulation of the shifting.

FIGS. 8 and 9A of the accompanying drawings show an example of shifting regulating structure for the end portion of film in a heat fixing apparatus. The shifting regulating structure shown in FIGS. 8 and 9A is provided at locations opposed to the opposite end portions of fixing film. FIG. 9B of the accompanying drawings is an enlarged view of the portion Z of FIG. 9A.

In FIG. 8, the reference numeral 21 designates a guide member for guiding the inner surface of sleeve-shaped fixing film 25. Fixing flanges 60 are fitted to the opposite end portions of the guide member 21. Each flange 60 is provided with an inner peripheral sliding portion 60*a* opposed to an end portion of the fixing film 25 for guiding the rotational locus of the film, a wall 60*b* substantially orthogonal to the film sliding surface (outer peripheral surface of the inner peripheral sliding portion so as to regulate the end portion position (end surface) of the fixing film 25, etc. The fixing film 25 is in pressure contact with a pressure roller, not shown, to thereby form a fixing nip portion, and receives a rotational force from the rotatively driven pressure roller and is rotated thereby. In a case where during the rotation, shifting in the generatrix direction occurs to the fixing film 25 as indicated by arrow A in FIG. 9A, the end portions (end surfaces) of the fixing film 25 are stopped by the walls 60*b* of the fixing flanges 60, and the fixing film 25 continues to rotate in that position.

In the conventional heat fixing apparatus as described above, however, there have arisen such problems as will be described below.

As the heat-resistant fixing film to be used in the above-described film heating process, use is made of a material such as heat-resisting resin film such as polyimide or PEEK, or metal film such as Ni electrocast film or stainless seamless film. The reason why these materials are used is that they are high in durability in terms of both heat resistance and strength even under a condition under which the fixing film slides while being directly in pressure contact with a heater (heat generating member) generating heat to 200° C. or higher.

In the aforedescribed heat fixing apparatus of the film heating type, however, even in a case where the material of high durability as described above is used for the fixing film 25, when besides the unevenness of the degree of cylindricality and thickness of the fixing film, the fluctuation of the diameter of the pressure roller which is a pressure member or when the balance of the pressure force is not sufficiently secured, the fixing film is biased to one end portion side of the heater in the longitudinal direction thereof (the axial direction of the pressure roller, and soon the end portions of the fixing film strike against the walls 60*b* of the fixing flanges 60. The material of the flanges 60 is resin, and the flanges are molded by a metal mold and therefore, as shown in FIG. 9B, a portion R exists in the intersecting portion between the inner peripheral sliding portion 60*a* and the wall 60*b*. Accordingly, if the fixing film continues to rotate while being in contact with the walls 60*b*, a force continues to be applied to the end portions of the fixing film 25 in a state in which it is pushed open from the inner surface side thereof to the outer surface side thereof, by the portion R in part working which is in the root portion, i.e., the intersecting portion, of the inner peripheral sliding portions 60*a* of the fixing flanges 60 with the walls 60*b* and therefore, fracture occurs, and finally the fixing film is broken into a strip shape, and this has sometimes caused such problems as a faulty image, the faulty fixing of a toner and paper jam.

SUMMARY OF THE INVENTION

The present invention has been made in view of the above-noted problems and an object thereof is to provide an image heating apparatus which is excellent in the durability of a flexible sleeve.

Another object of the present invention is to provide an image heating apparatus in which the damage of the end portions of a flexible sleeve can be suppressed.

Still another object of the present invention to provide an image heating apparatus comprising:

a flexible sleeve; and a regulating member disposed at a position opposed to an end surface of the sleeve for regulating the movement of the sleeve in the generatrix direction thereof, the regulating member having a first surface opposed to the end surface of the sleeve, and a second surface opposed to the inner peripheral surface of the end portion of the sleeve in the generatrix direction thereof;

wherein the regulating member is a combination of a first part having the first surface and a second part having the second surface.

Further objects of the present invention will become apparent from the following detailed description when read with reference to the accompanying drawings.

DESCRIPTION OF THE PREFERRED EMBODIMENTS

Some embodiments of the present invention will hereinafter be described in detail with reference to the accompanying drawings.

Embodiment 1

(1) Example of an Image Forming Apparatus

Figure 1:
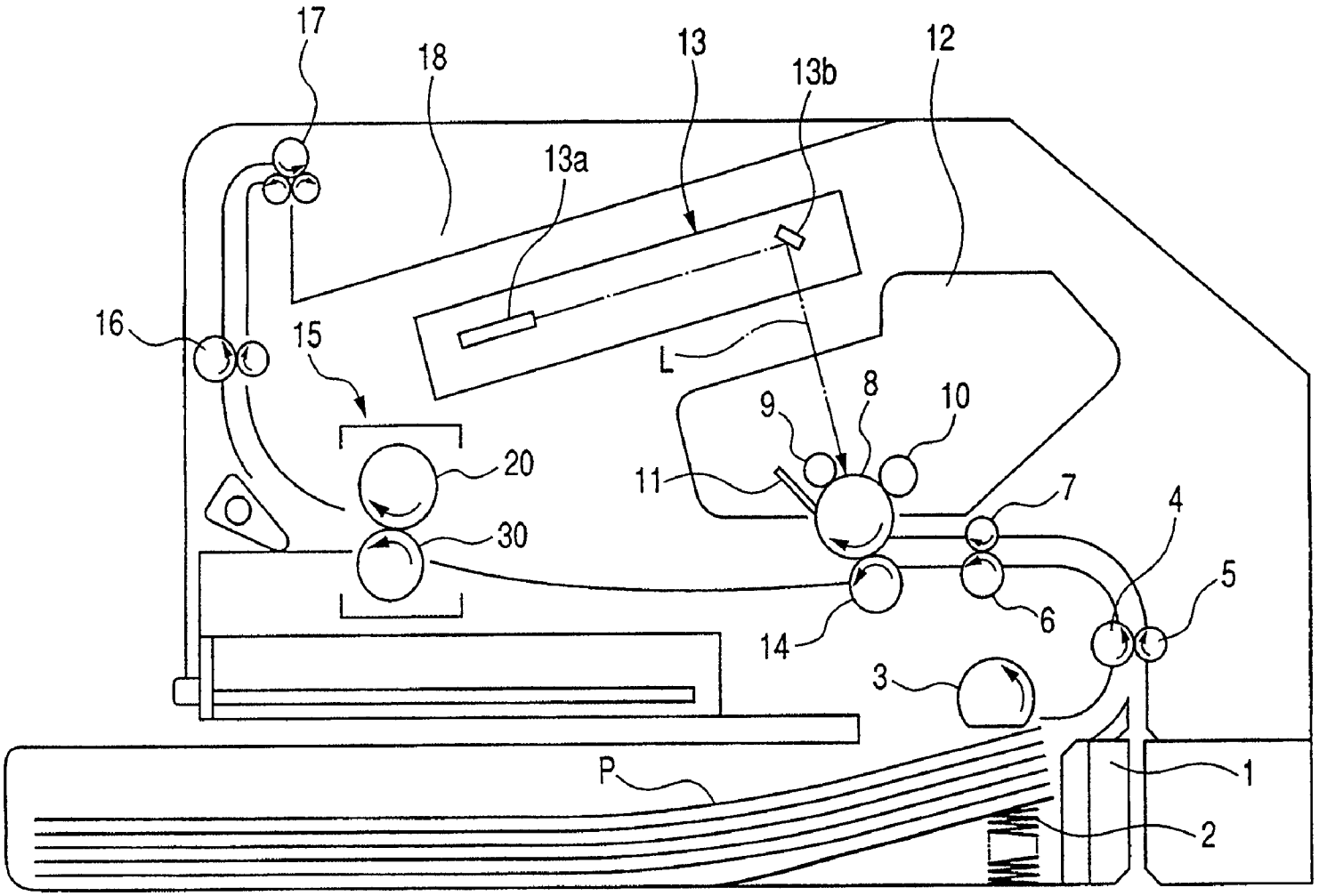
FIG. 1 is a schematic model view showing the construction of an example of an image forming apparatus carrying the image heating apparatus of the present invention thereon.

FIG. 1 is a schematic model view showing the construction of an example of an image forming apparatus carrying the image heating apparatus of the present invention thereon. This example of the image forming apparatus is a laser printer utilizing a transfer type electrophotographic process.

This image forming apparatus is provided with a sheet feeding apparatus comprising a sheet feeding tray 1, a sheet stacking stand 2 and a sheet feeding roller 3. Recording materials P as materials to be heated stacked in the sheet stacking stand 2 in the sheet feeding tray 1 are picked up one by one in succession from the uppermost recording material by the sheet feeding roller 3, and are conveyed to a registration portion by a conveying roller 4 and a conveying runner 5. The recording material P has its conveying direction made uniform by the registration portion comprising a registration roller 6 and a registration runner 7, and thereafter is fed to an image forming portion.

The image forming portion is constituted by making a drum-shaped photosensitive member (hereinafter referred to as the photosensitive drum) 8 as an image bearing member, a charging device (charging means) 9 for charging the photosensitive drum, a developing device (developing means) 10 for developing a latent image on the photosensitive drum with a toner, a cleaner (cleaning means) 11 for removing and containing any residual toner on the photosensitive drum, etc. into a unit as a toner cartridge 12. A laser scanner unit 13 as an exposing apparatus (image data converting portion) is constituted by a polygon mirror 13*a*, a reflecting mirror 13*b*, a polygon mirror rotating motor, not shown, a laser unit, etc. being made into a unit.

The photosensitive drum 8 is rotatively driven at a predetermined speed in the clockwise rotation of arrow, and is uniformly charged to a predetermined polarity and predetermined potential in the rotating process thereof, and a laser beam L based on an image information pattern is applied from the laser scanner unit 13 to the uniformly charged surface of the photosensitive drum 8. Thereby, an electrostatic latent image corresponding to the scanned and exposed image information pattern is formed on the photosensitive drum 8 in an electrophotographic process. This latent image is developed by the developing device 10 with the aid of a toner as a developer, and this developed toner image is transferred from the photosensitive drum 8 to the recording material P by a transfer roller (transferring means) 14.

The recording material P to which the toner image has been transferred is conveyed to a heat fixing apparatus 15 comprising a heating unit 20 and a pressure roller 30 as a pressure member, and the unfixed toner image on the recording material is heated and fixed as a permanent fixed image by the heat fixing apparatus. The fixing apparatus 15 in the present embodiment is a heat fixing apparatus of a film heating type and pressure roller driving type. This heat fixing apparatus (hereinafter referred to as the fixing apparatus) 15 will be described in detail under the next item (2).

The recording material P having left the fixing apparatus 15 is discharged onto a sheet discharging tray 18 by a sheet discharging unit comprising intermediate sheet discharging rollers 16, sheet discharging rollers 17, etc.

The cleaner (cleaning means) 11 removes a residual contaminant such as an untransferred toner from the surface of the photosensitive drum 8 after the separation of the recording material therefrom and cleans the surface of the photosensitive drum, thus rendering the repetitive use of the photosensitive drum 8 possible.

Figure 2:
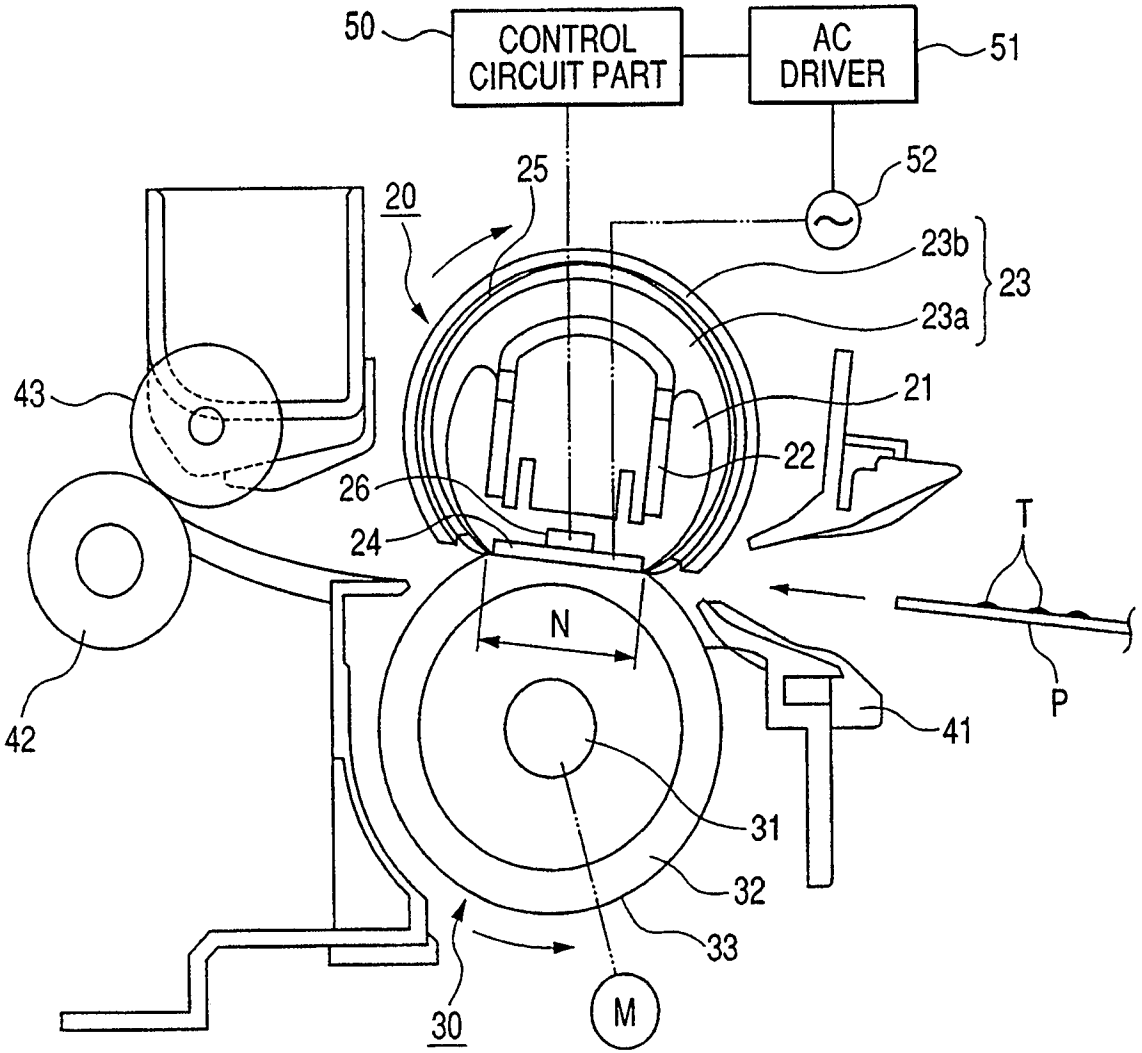
FIG. 2 is a cross-sectional view of an example of the image heating apparatus according to the present invention.
Figure 3:
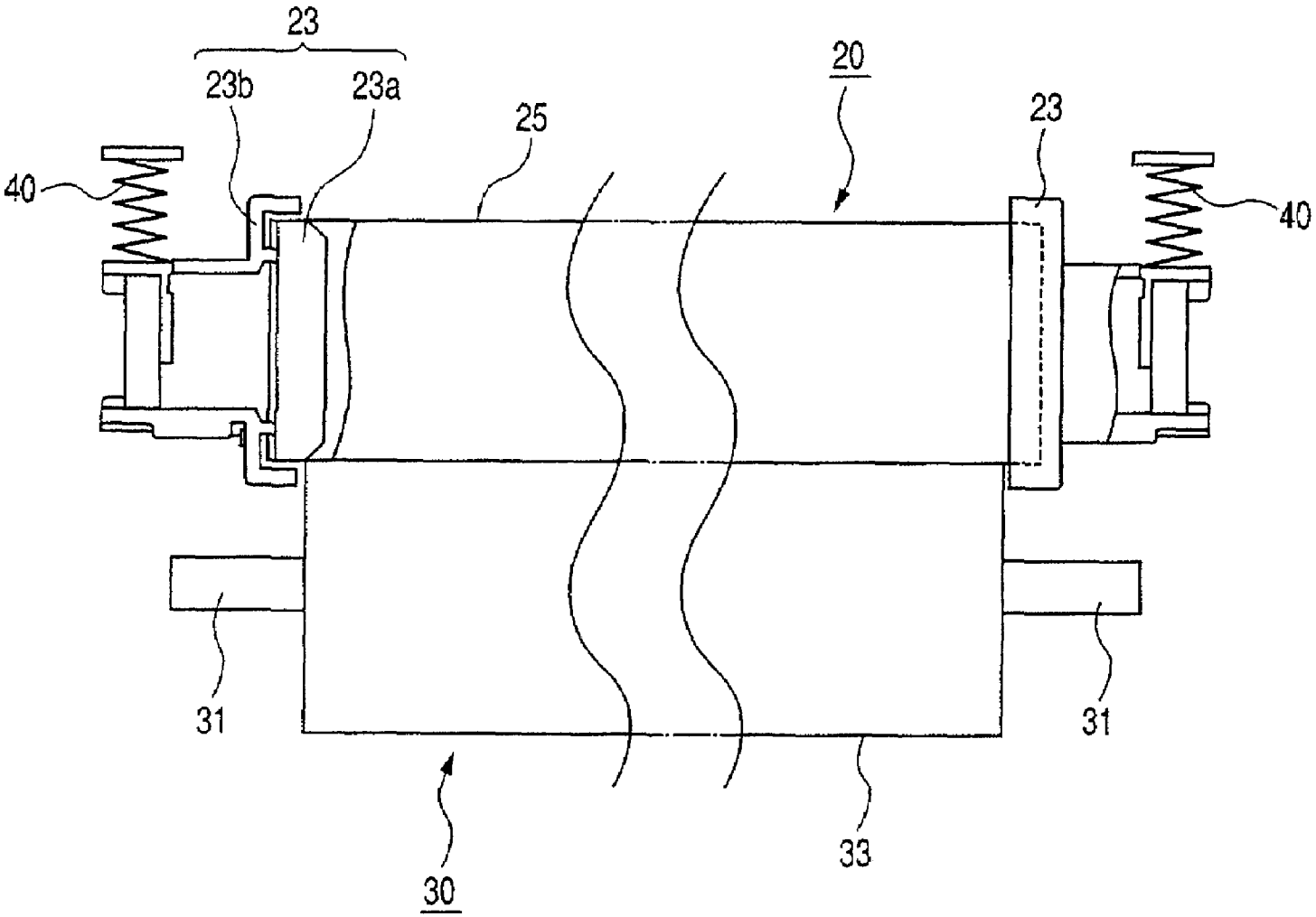
FIG. 3 is an intermediate portion omitted and partly cut-away front view of the image heating apparatus shown in FIG. 2.

(2) Fixing Apparatus 15 FIG. 2 is a cross-sectional view of the fixing apparatus 15, and FIG. 3 is an intermediate portion omitted and partly cut-away front view of the image heating apparatus. The fixing apparatus in the present embodiment is a heating apparatus of a film heating type-pressurizing rotary member driving type (tensionless type) using cylindrical (endless-belt-shaped) fixing film (flexible sleeve), and a fixing nip portion N as a heating nip portion is formed by the pressure contact between the heating unit 20 and the pressure roller 30.

The heating unit 20 comprises a film guide member 21 having heat resistance, an adiabatic property and rigidity, fixing flanges (regulating members) 23 fitted to the opposite end portions of the film guide member 21 with a holding stay 22 interposed therebetween, a ceramic heater as a heating member 24 fitted and fixedly disposed in a concave groove portion provided in the underside of the film guide member 21 along the length thereof and adapted to be electrically energized to thereby generate heat, fixing film 25 as a flexible sleeve loosely fitted onto the film guide member 21 having the heater 24 mounted thereon, etc. The film guide member 21 is disposed in the interior of the fixing film 25 along the generatrix direction of the fixing film.

The fixing film 25, in order to make its heat capacity small and improve its quick starting property, has its total thickness made equal to or less than 100 μm, and preferably equal to or less than 60 μm and equal to or greater than 20 μn, and uses heat resisting resin film such as polyimide or PEEK or metal film such as Ni electrocast film or stainless seamless film. The metal film is good in heat conductivity and therefore, the thickness thereof equal to or less than 150 μm becomes sufficiently practically usable. A mold releasing layer is formed as the surface layer of the fixing film 25.

The pressure roller 30 is a rotary member comprising a mandrel 31 and an elastic layer 32 of heat resisting rubber such as silicone rubber or fluorine resin formed on the mandrel concentrically and integrally therewith or formed by foaming silicone rubber. A heat resisting mold releasable layer 33 formed of fluorine resin such as PFA, PTFE or FEP or the like may be formed on the elastic layer 32.

The pressure roller 30 is disposed with the opposite end portions of the mandrel 31 rotatably bearing-held between the side plates of a fixing apparatus chassis (not shown) on the front side and the rear side thereof through a bearing member. The heating unit 20 is disposed on the upper side of this pressure roller 30 in parallel to the pressure roller 30 with the heater 24 side thereof facing down. The fixing flanges 23 are biased toward the pressure roller 30 by pressurizing means 40 such as a spring, and by this construction, the downwardly facing surface of the heater 24 is brought into pressure contact with the elastic layer 32 of the pressure roller 30 with a predetermined pressure force against the elasticity of this elastic layer with the fixing film 25 interposed therebetween, to thereby form a fixing nip portion N having a predetermined width necessary for heat fixing. There can be adopted an apparatus construction in which the pressure roller 30 side is upwardly biased toward the underside of the heating unit 20 by pressurizing means to thereby form the fixing nip portion N having a predetermined width.

The pressure roller 30 is rotatively driven by a motor M which is a drive source through a drive transmitting system, not shown. When the pressure roller 30 is rotated, the fixing film 25 is driven to rotate with its inner peripheral surface brought into close contact with the heater 24 by a frictional force. Accordingly, the recording material P bearing a toner image T thereon is conveyed between the fixing film 25 and the pressure roller 30 in the fixing nip portion N, and in this conveying process, the toner image T is heated and fixed.

a) First Embodiment of the Fixing Flange (Regulating Member) 23

Figure 4A:
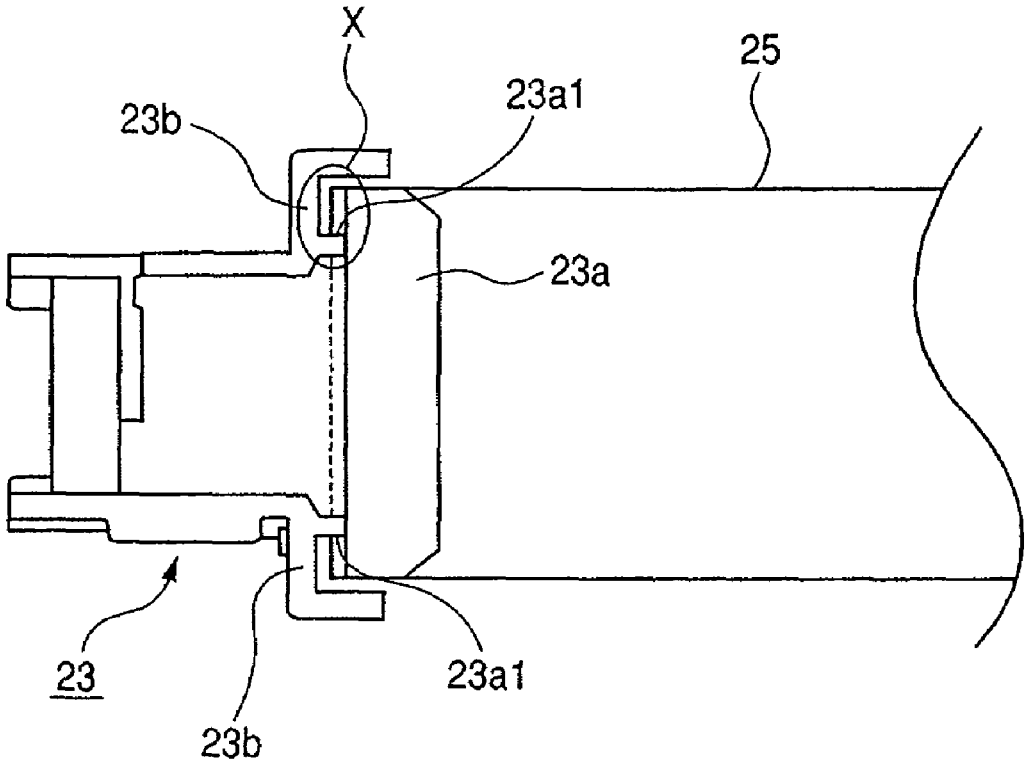
FIG. 4A is a cross-sectional view showing an example of a fixing flange.
Figure 4B:
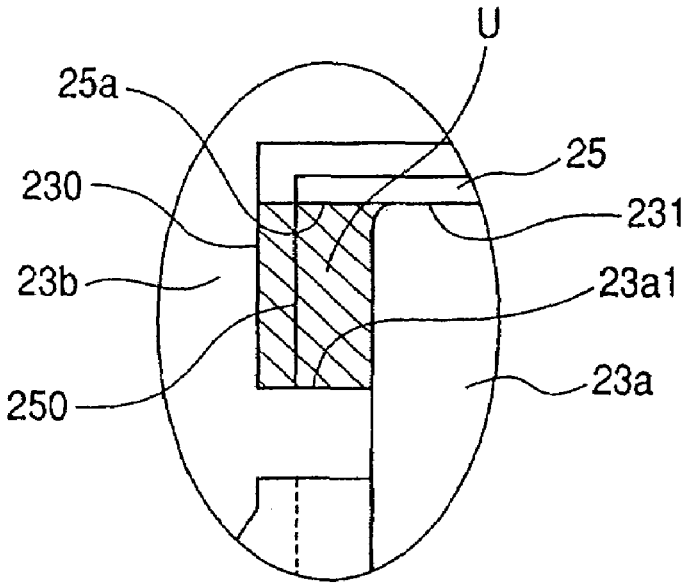
FIG. 4B is an enlarged view of the portion Z of FIG. 4A.

FIG. 4A shows an end portion of the fixing flange 23. FIG. 4B is an enlarged view of the portion X of FIG. 4A.

As shown in FIGS. 4A and 4B, the fixing flange 23 is disposed at a position opposed to an end surface of the fixing film 25 and corresponding to an end portion of the guide member 21. Also, the fixing flange 23 has an inner peripheral sliding portion 23*a* having a sliding surface (second surface) 231 opposed to the inner peripheral surface of an end portion of the fixing film 25. This inner peripheral sliding portion 23*a* has the function of guiding the rotational locus of the fixing film 25. Also, the fixing flange 23 is provided with an outer peripheral wall 23*b* substantially orthogonal to the film sliding surface (outer peripheral surface) 231 of the inner peripheral sliding portion so as to regulate the end portion position of the fixing film 25, etc. The outer peripheral wall 23*b* has a regulating surface (first surface) 230 opposed to the end surface 250 of the fixing film 25. The movement of the fixing film 25 in the generatrix direction thereof is regulated by the regulating surface 230. The root portion, i.e., the intersecting portion with the outer peripheral wall 23*b*, of the inner peripheral sliding portion 23*a* is of a substantially groove shape 23*a*1, and there exists an undercut area U (the hatched area of FIG. 4B: in the case of one-piece structure, an area which cannot be molded by a metal mold) formed by this shape and therefore, the inner peripheral surface 25*a* of the end portion of the fixing film 25 is adapted not to contact with the sliding surface 231 of the inner peripheral sliding portion 23*a*.

Figure 5:
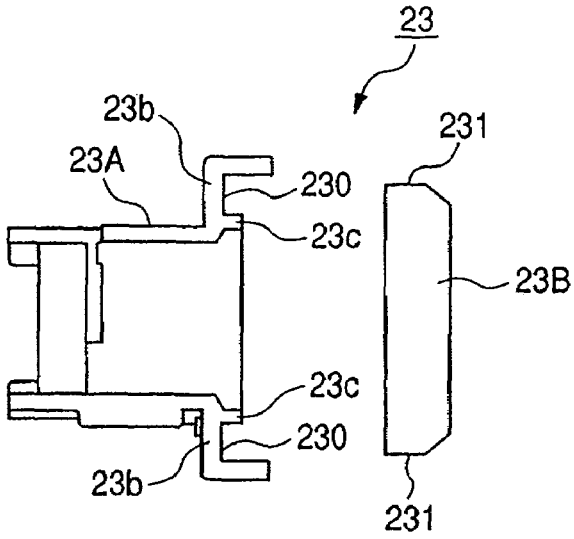
FIG. 5 is an illustration showing a state in which the fixing flange shown in FIG. 4 is divided into two parts.

The fixing flange 23 shown in the present embodiment, as shown in FIG. 5., assumes two-piece structure comprising a combination of two parts, i.e., a base portion (first part) 23A having an outer peripheral wall 23*b* and a convex joint portion 23*c* inside this outer peripheral wall, and a cap portion (second part) 23B as the inner peripheral sliding portion 23*a*. By adopting the two-piece structure, the undercut shape 23*a*1 can be easily formed when it is molded by the use of a metal mold. The cap portion 23B is fixed to e.g. the joint portion 23*c* of the base portion 23A by suitable fixing means such as a snap hook or an adhesive agent.

The ceramic heater 24 includes an electrically energized heat generating member (resistance heat generating member) as a heat generating source which generates heat by the supply of electric power, and rises in temperature by the heat generation of this electrically energized heat generating member. This heater 24 uses alumina ($Al_2O_3$) or aluminum nitride (AlN) as the material of a substrate, and a resistance heat generating member formed of silver and palladium is thick-film-printed on the substrate to thereby form a heat generating member pattern having a desired resistance value. Further, a glass layer protecting the heat generating member, and yet sliding relative to the fixing film is formed on the heat generating member. A thermistor 26 which is a temperature detecting element is adhesively fixed to the back side of the heat generating member forming surface to thereby monitor the temperature of the heater, and the monitored temperature information is inputted to a control circuit part 50. The control circuit part 50 controls an AC driver 51 and controls the amount of power supply from an AC power source 52 to the heat generating member of the heater 24 in order to maintain the temperature of the heater (the temperature of the fixing nip portion) at a predetermined temperature.

In a state in which the heater 24 is heated by the supply of electric power to the electrically energized heat generating member and the fixing film 25 is rotatively driven, the leading edge of the recording material P is introduced along a fixing entrance guide 41 into the pressure contact nip portion N (fixing nip portion) formed between the pressure roller 30 and the heater 24 by an elastic force produced by the deformation of the elastic layer 32 of the pressure roller 30, whereby the recording material P passes through the fixing nip portion N together with the fixing film while being in close contact with the fixing film.

In this process of passage of the recording material P through the fixing nip portion, heat energy is imparted from the heater 24 to the recording material P through the fixing film 25, whereby the unfixed toner image T on the recording material P is heated, fused and fixed.

The fixing film 25 in its rotatively driven state is biased to one end portion of the heater 24 in the longitudinal direction thereof (the axial direction of the pressure roller 30), and even when the end portion of the fixing film strikes against the regulating surfaces 230 of the outer peripheral walls 23*b* of the fixing flanges 23, a force in a direction in which the fixing film is pushed open from its inner surface side to its outer surface side is not applied to the end portion of the fixing film because the root portion of the inner peripheral sliding portion 23*a* is of the undercut shape 23*a*1, and fracture or breakage can be prevented from occurring to the end portion of the fixing film.

The recording material P on which the unfixed toner image T has been heated, fused and fixed passes through the fixing nip portion N, and is separated and discharged from the fixing film 25, and is conveyed to a sheet discharging portion by an FU sheet discharging roller 43 and an FU sheet discharging runner 42.

b) Second Embodiment of the Fixing Flange 23

Figure 6A:
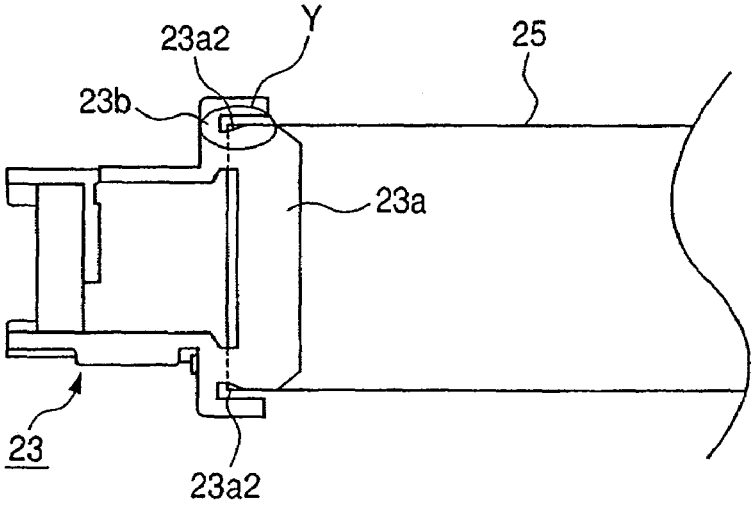
FIG. 6A is a cross-sectional view showing another example of the fixing flange.
Figure 6B:
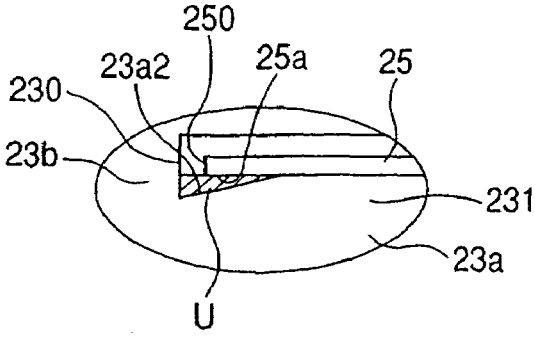
FIG. 6B is an enlarged view of the portion Y of FIG. 6A.

FIG. 6A shows a second embodiment of the fixing flange 23. FIG. 6B is an enlarged view of the portion Y of FIG. 6A. Members and portions common to those of the fixing flange of the aforedescribed first embodiment are given the same reference characters and need not be described again.

In the present embodiment, the fixing flange 23 is such that the root portion, i.e., the intersecting portion with the outer peripheral wall 25*b*, of the inner peripheral sliding portion 23*a* is formed into a tapered shape 23*a*2 inclined to the inner side of this outer peripheral wall 25*b* so as not to contact with the inner peripheral surface 25*a* of the end portion of the fixing film 25. This tapered shape portion 23*a*2 forms an undercut area U.

Figure 7:
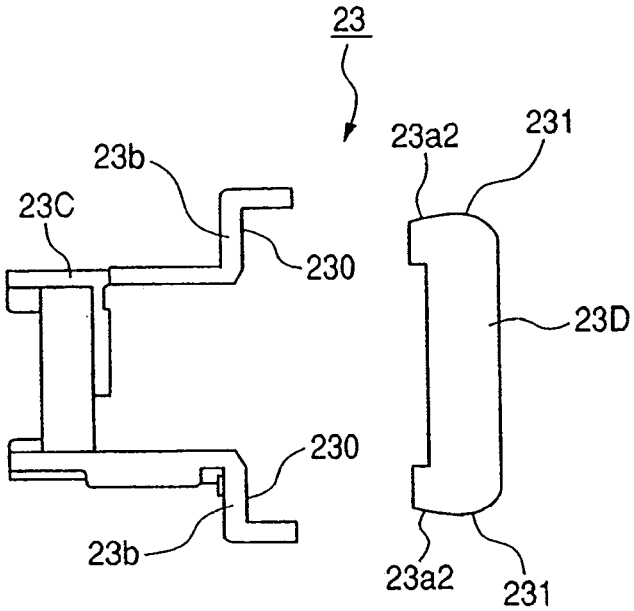
FIG. 7 is an illustration showing a state in which the fixing flange shown in FIG. 6 is divided into two parts.
Figure 8:
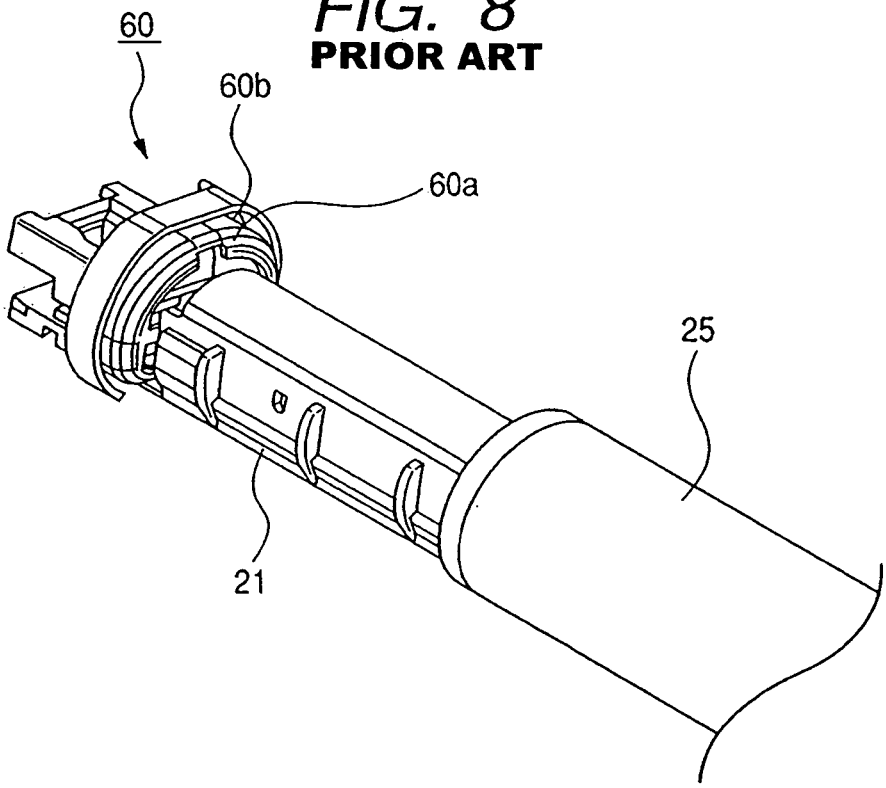
FIG. 8 PRIOR ART
FIG. 8 is a perspective view showing an example of a fixing flange in a conventional heat fixing apparatus.
Figure 9A:
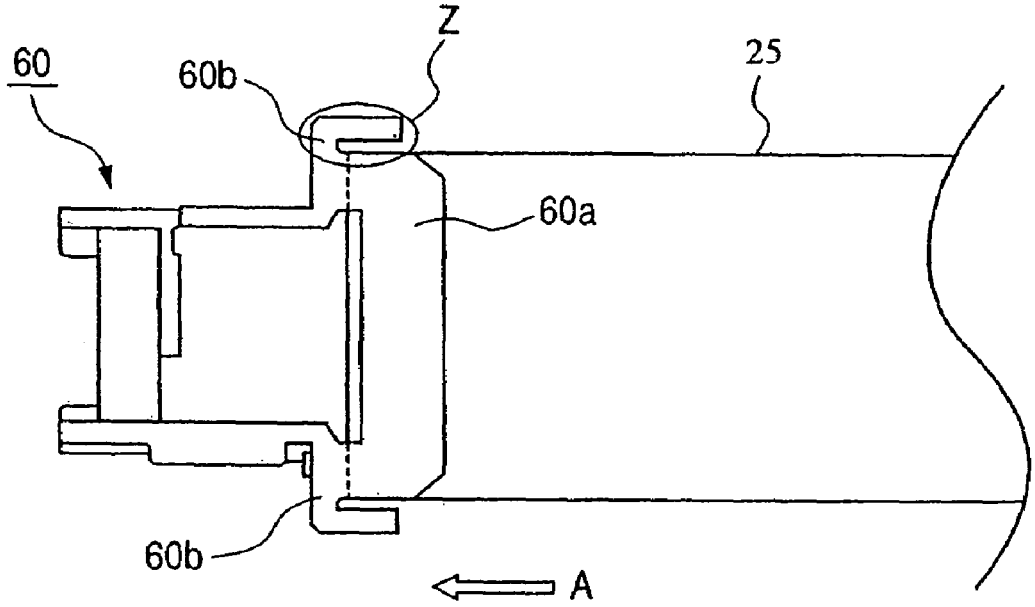
FIG. 9A PRIOR ART
FIG. 9A is a cross-sectional view of the fixing flange shown in FIG. 8.
Figure 9B:
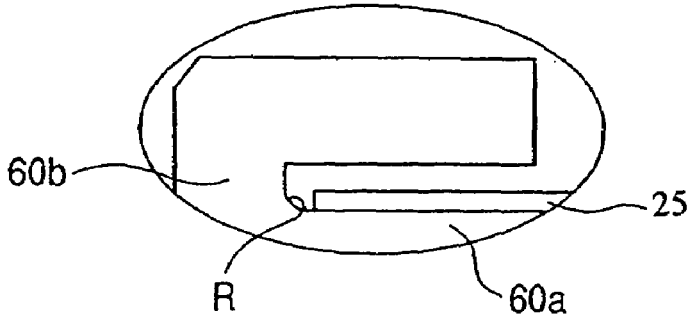
FIG. 9B PRIOR ART
FIG. 9B is an enlarged view of the portion Z of FIG. 9A.

The fixing flange 23 shown in the present embodiment, as shown in FIG. 7, assumes two-piece structure comprising a combination of a base portion 23C (first part) having an outer peripheral wall 23*b*, and a cap portion 23D (second part) as an inner peripheral sliding portion 23*a* having the tapered shape portion 23*a*2 on the outer peripheral wall 23*b* side of the base portion 23C. The outer peripheral wall 23*b* of the base portion 23C has a regulating surface (first surface) 230 opposed to the end surface 250 of the fixing film 25. The movement of the fixing film 25 in the generatrix direction thereof is regulated by this regulating surface 230. Also, the cap portion 23D has an inner peripheral sliding portion 23*a* having a sliding surface (second surface) 231 opposed to the inner peripheral surface 25*a* of the end portion of the fixing film 25.

As described above, the fixing flange of the present embodiment is also made into the two-piece structure, whereby when it is to be molded by the use of a metal mold, the undercut shape (tapered shape) 23*a*2 can be formed easily. The cap portion 23D has its tapered shape portion 23*a*2 side fixed to the outer peripheral wall 23*b* of the base portion 23A by suitable fixing means such as, for example, a snap hook or an adhesive agent.

In a case where the fixing flange 23 shown in the present embodiment is used instead of the fixing flange 23 of the first embodiment, even if the fixing film 25 in its rotatively driven state is biased toward one end portion of the heater 24 in the longitudinal direction thereof (the axial direction of the pressure roller 30) and the end portion of the fixing film strikes against the outer peripheral wall 23*b* of the fixing flange 23, a force in a direction in which the fixing film is pushed open from its inner surface side to its outer surface side is not applied to the end portion of the fixing film because the root portion of the inner peripheral sliding portion 23*a* is of the tapered shape 23*a*2, and fracture or breakage can be prevented from occurring to the end portion of the fixing film.

As described above, according to the fixing apparatus of the present embodiment, even if the fixing film 25 draws near in the generatrix direction thereof, the end portion thereof can be prevented from contacting with the fixing flange 23 to thereby cause the breakage of the end portion of the film, and in spite of a simple construction and a low cost, the energy saving property and the quick starting property are not spoiled and moreover, the breakage of the end portion of the film can be prevented and a sufficient fixing property can be obtained.

[Others]

1) The shape of the root portion of the inner peripheral sliding portion 23*a* of the fixing flange 23 is not restricted to a substantially groove shape or a tapered shape, but may be any shape which does not contact with the inner peripheral surface 25*a* of the fixing film 25.

2) The heating member need not always be located at the fixing nip portion N. The heating of the fixing film 25 can be effected from the inner surface side or the outer surface side of the film by any heating means.

3) While in the embodiment, the sleeve-shaped fixing film 25 is driven to rotate by the driving of the pressure roller, use can be made of any rotative driving means such as providing a drive roller and a tension roller in the interior of endless film and rotatively driving the drive roller to thereby rotate the film. The material of the fixing film 25 is not restricted to a heat-resistant resin material, but can be a metal material, a compound material of plural materials or the like. The fixing film 25 itself can also be an electromagnetic induction heat generating member.

4) The heating apparatus according to the present invention is applicable not only to a heat fixing apparatus (on-demand fixing apparatus) of a film heating type which heats a recording material through thin film, but also to another heat fixing apparatus using thin endless-belt-shaped fixing film. It can also be effectively applied, to an image heating apparatus such as, for example, a tentative fixing apparatus for tentatively fixing an unfixed image on a recording material, or a surface property improving apparatus for re-heating a recording material bearing a fixed image thereon to thereby improve the surface property of the image such as gloss. Of course, besides those, the heating apparatus according to the present invention can also be effectively used as a heating apparatus for heat-processing a material to be heated, such as, for example, a heat press apparatus for removing the wrinkles of a bank note, a heat laminate apparatus, a heating and drying apparatus for evaporating moisture contained in paper or the like, or a heating apparatus for drying used in an ink jet printer or the like.

The present invention is not restricted to the above-described embodiments, but covers modifications within the technical idea of the invention.

This application claims priority from Japanese Patent Application No. 2004-105248 filed on Mar. 31, 2004, which is hereby incorporated by reference herein.

What is claimed is:

1. An image heating apparatus for heating an image formed on a recording material, comprising:

a flexible sleeve; and a regulating member disposed at a position opposed to an end surface of said sleeve for regulating movement of said sleeve in a generatrix direction thereof, wherein said regulating member is an assembly with a first piece having a first surface opposed to the end surface of said sleeve and a second piece having a second surface opposed to an inner peripheral surface of an end portion of said sleeve in the generatrix direction thereof.

2. An image heating apparatus according to claim 1, wherein there is an undercut area between said first piece and said second piece of said regulating member.

3. An image heating apparatus according to claim 1, further comprising a guide member disposed in the interior of said sleeve along the generatrix direction thereof for guiding a rotation of said sleeve, and wherein said regulating member is disposed at a position corresponding to an end portion of said guide member in the generatrix direction of said sleeve.

4. An image heating apparatus according to claim 3, further comprising a heater contacting with the inner peripheral surface of said sleeve, and a pressure roller, and wherein said heater is held on said guide member, and a nip portion for nipping and conveying the recording material is formed by said heater and said pressure roller with said sleeve interposed therebetween.

5. An image heating apparatus according to claim 1, said regulating member having a third surface opposed to an outer peripheral surface of the end portion of said sleeve.

6. An image heating apparatus according to claim 5, wherein the third surface is provided on said first piece of said regulating member.

7. An image heating apparatus according to claim 1, wherein said first piece of said regulating member and said second piece of said regulating member are made of resin by forming with a die.

8. An image heating apparatus for heating an image formed on a recording material, comprising:

a flexible sleeve; and a regulating member disposed at a position opposed to an end surface of said sleeve for regulating movement of said sleeve in a generatrix direction thereof, said regulating member having a first surface opposed to the end surface of said sleeve, and a second surface opposed to an inner peripheral surface of an end portion of said sleeve in the generatrix direction, wherein said regulating member has an undercut area at a side of the first surface on the second surface.

9. An image heating apparatus according to claim 8, further comprising a guide member disposed in an interior of said sleeve along the generatrix direction thereof for guiding rotation of said sleeve, and wherein said regulating member is disposed at a position corresponding to an end portion of said guide member in the generatrix direction of said sleeve.

10. An image heating apparatus according to claim 9, further comprising a heater contacting with the inner peripheral surface of said sleeve, and a pressure roller, and wherein said heater is held on said guide member, and a nip portion for nipping and conveying the recording material is formed by said heater and said pressure roller with said sleeve interposed therebetween.

11. An image heating apparatus according to claim 8, said regulating member having a third surface opposed to an outer peripheral surface of the end portion of said sleeve.

* * * * *